US011015233B2

(12) United States Patent
Tsukamoto et al.

(10) Patent No.: US 11,015,233 B2
(45) Date of Patent: May 25, 2021

(54) TITANIUM ALLOY PART

(71) Applicant: NIPPON STEEL CORPORATION, Tokyo (JP)

(72) Inventors: Genki Tsukamoto, Tokyo (JP); Kazuhiro Takahashi, Tokyo (JP); Hideto Seto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/637,941

(22) PCT Filed: Aug. 28, 2018

(86) PCT No.: PCT/JP2018/031836
§ 371 (c)(1),
(2) Date: Feb. 10, 2020

(87) PCT Pub. No.: WO2019/044858
PCT Pub. Date: Mar. 7, 2019

(65) Prior Publication Data

US 2020/0172996 A1 Jun. 4, 2020

(30) Foreign Application Priority Data

Aug. 28, 2017 (JP) ..... JP2017-163700

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS 5,277,718 A * 1/1994 Paxson ..... C22F 1/183 148/417
5,417,779 A * 5/1995 Griebel, III ..... C22C 14/00 148/421

(Continued)

FOREIGN PATENT DOCUMENTS

JP 7-43478 A 2/1995
JP 7-62466 A 3/1995

(Continued)

OTHER PUBLICATIONS

International Preliminary Report on Patentability and Written Opinion of the International Searching Authority (Forms PCT/IB/373, PCT/IB/326, and PCT/ISA/237) for International Application No. PCT/JP2018/031836, dated Mar. 12, 2020, with English translation.

(Continued)

*Primary Examiner* — Anthony J Zimmer
*Assistant Examiner* — Jacob James Gusewelle
(74) *Attorney, Agent, or Firm* — Birch, Stewart, Kolasch & Birch, LLP

(57) ABSTRACT

A titanium alloy part is characterized in that it includes, by mass %: Al: 1.0 to 8.0%; Fe: 0.10 to 0.40%; O: 0.00 to 0.30%; C: 0.00 to 0.10%; Sn: 0.00 to 0.20%; Si: 0.00 to 0.15%; and the balance: Ti and impurities, in which: an average grain diameter of α-phase crystal grains is 15.0 μm or less; an average aspect ratio of the α-phase crystal grains is 1.0 or more and 3.0 or less; and a coefficient of variation of a number density of β-phase crystal grains distributed in the α phase is 0.30 or less.

3 Claims, 3 Drawing Sheets

(56) References Cited

U.S. PATENT DOCUMENTS

| | | | | |
|---|---|---|---|---|
| 5,509,979 | A | 4/1996 | Kimura | |
| 5,759,484 | A * | 6/1998 | Kashii | C22C 14/00 148/421 |
| 6,332,935 | B1 * | 12/2001 | Gorman | C22F 1/183 148/508 |
| 2003/0168138 | A1 * | 9/2003 | Marquardt | C22C 14/00 148/671 |
| 2004/0089380 | A1 * | 5/2004 | Woodfield | B21K 1/28 148/671 |
| 2009/0074606 | A1 | 3/2009 | Ogawa et al. | |
| 2009/0181794 | A1 | 7/2009 | Tsai et al. | |
| 2012/0234066 | A1 * | 9/2012 | Takahashi | C22F 1/183 72/200 |
| 2017/0067137 | A1 * | 3/2017 | Kawasaki | C22C 14/00 |

FOREIGN PATENT DOCUMENTS

| | | | |
|---|---|---|---|
| JP | 7-150274 | A | 6/1995 |
| JP | 2009-84690 | A | 4/2009 |
| JP | 2009-167518 | A | 7/2009 |
| JP | 2017-53021 | A | 3/2017 |

OTHER PUBLICATIONS

International Search Report for PCT/JP2018/031836 dated Nov. 20, 2018.

Written Opinion of the International Searching Authority for PCT/JP2018/031836 (PCT/ISA/237) dated Nov. 20, 2018.

* cited by examiner

TITANIUM ALLOY PART

TECHNICAL FIELD

The present invention relates to a titanium alloy part suitable for mirror polishing.

BACKGROUND ART

As a material used for an ornament such as a brooch, there can be cited stainless steel and a titanium alloy. The titanium alloy is more suitable for an ornament than the stainless steel in terms of a specific gravity, a corrosion resistance, biocompatibility, and so on. However, the titanium alloy is inferior to the stainless steel in terms of a specularity after polishing.

Although it is also possible to improve the specularity by increasing hardness of the titanium alloy through control of a chemical composition, in a conventional titanium alloy, workability is greatly reduced in accordance with an increase in hardness. The reduction in workability makes it difficult, for example, to perform microfabrication for ornamentation.

For example, Patent Document 1 describes that high hardness and improvement of specularity are realized by a titanium alloy in which iron of 0.5% or more by weight is contained. Patent Document 2 describes that high hardness is realized by a titanium alloy in which iron of 0.5 to 5% by weight is contained and a two-phase microstructure of α and β is provided. Patent Document 3 describes a titanium alloy containing 4.5% of Al, 3% of V, 2% of Fe, 2% of Mo, and 0.1% of 0, and whose crystal microstructure is of α+β type.

PRIOR ART DOCUMENT

[Patent Document]

Patent Document 1: Japanese Laid-open Patent Publication No. H7-043478

Patent Document 2: Japanese Laid-open Patent Publication No. H7-062466

Patent Document 3: Japanese Laid-open Patent Publication No. H7-150274

DISCLOSURE OF THE INVENTION

Problems to be Solved by the Invention

However, in the titanium alloys described in Patent Documents 1 and 2, there is a possibility that a temperature is increased by a frictional heat generated during polishing, resulting in that the hardness is reduced to deteriorate the specularity. In the titanium alloy described in Patent Document 3, Vickers hardness is excessively high to be 400 or more, and although an excellent specularity can be obtained, it becomes difficult to perform machining.

The present invention has an object to provide a titanium alloy part having good workability and capable of obtaining an excellent specularity.

Means for Solving the Problems

The gist of the present invention is as follows.

(1) A titanium alloy part is characterized in that it includes, by mass %:

Al: 1.0 to 8.0%;

Fe: 0.10 to 0.40%;

O: 0.00 to 0.30%;

C: 0.00 to 0.10%;

Sn: 0.00 to 0.20%;

Si: 0.00 to 0.15%; and the balance: Ti and impurities, in which:

an average grain diameter of α-phase crystal grains is 15.0 μm or less;

an average aspect ratio of the α-phase crystal grains is 1.0 or more and 3.0 or less; and a coefficient of variation of a number density of β-phase crystal grains distributed in the α phase is 0.30 or less.

(2) The titanium alloy part according to (1), where in an average number of deformation twins per one α-phase crystal grain is 2.0 to 10.0.

Note that in the present Description, the α-phase crystal grain is sometimes referred to as an "α grain". Further, the β-phase crystal grain is sometimes referred to as a "β grain".

Effect of the Invention

According to the present invention, it is possible to provide a titanium alloy part having good workability and capable of obtaining an excellent specularity.

EMBODIMENTS FOR CARRYING OUT THE INVENTION

Figure 1:
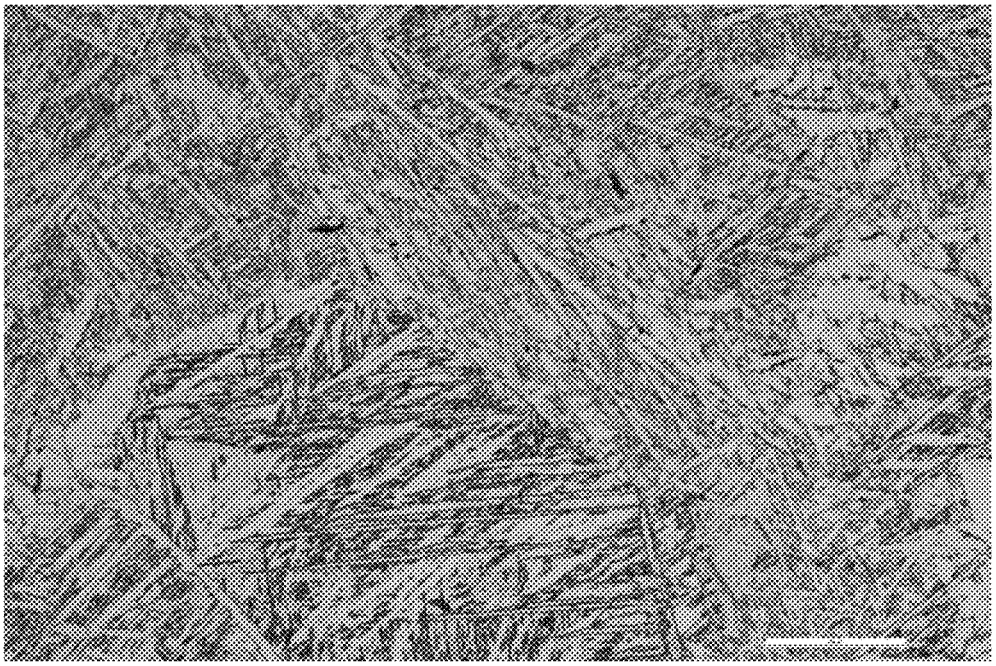
FIG. 1 is an optical micrograph of an α-phase microstructure in an α+β-type two-phase alloy with an acicular microstructure.

Hereinafter, an embodiment of the present invention will be explained.

[Chemical Composition]

A chemical composition of a titanium alloy part according to the present embodiment will be described in detail. As will be described later, the titanium alloy part according to the present embodiment is manufactured through hot rolling, annealing, cutting, scale removal, hot forging, machining, mirror polishing, and the like. Therefore, the chemical composition of the titanium alloy part is suitable for not only properties of the titanium alloy part but also the above treatment. In the following explanation, "%" which is a unit of a content of each element contained in the titanium alloy part means "mass %", unless otherwise noted. The titanium alloy part according to the present embodiment includes Al: 1.0 to 8.0%, Fe: 0.10 to 0.40%, O: 0.00 to 0.30%, C: 0.00 to 0.10%, Sn: 0.00 to 0.20%, Si: 0.00 to 0.15%, and a balance: Ti and impurities.

(Al: 1.0 to 8.0%)

Al suppresses a reduction in hardness due to a temperature rise during mirror polishing, particularly dry polishing. If an Al content is less than 1.0%, it is not possible to obtain sufficient hardness at a time of the mirror polishing, and an excellent specularity cannot be obtained. Therefore, the Al content is 1.0% or more, and preferably 1.5% or more. On the other hand, if the Al content exceeds 8.0%, the hardness becomes excessively large (for example, Vickers hardness Hv5.0 exceeds 400), and sufficient workability cannot be obtained. Therefore, the Al content is 8.0% or less, preferably 6.0% or less, and more preferably 5.0% or less. The Al content is still more preferably 4.0% or less.

(Fe: 0.10 to 0.40%)

Fe is a β-stabilizing element, and suppresses growth of α-phase crystal grains by a pinning effect provided by a generation of β phase. Although details will be described later, as the α-phase crystal grains are smaller, an unevenness is smaller and a specularity is higher. If an Fe content is less than 0.10%, the growth of α-phase crystal grains cannot be sufficiently suppressed, and the excellent specularity cannot be obtained. Therefore, the Fe content is 0.10% or more, and preferably 0.15% or more. On the other hand, Fe has a high contribution to 0-stabilization, and a slight difference in an addition amount greatly affects a β-phase fraction, and a temperature $T_{\beta 20}$ at which the β-phase fraction becomes 20% greatly fluctuates. If the temperature $T_{\beta 20}$ becomes lower than a forging temperature, there can be considered a case where an acicular microstructure is formed and an average value of an aspect ratio of the α-phase crystal grains exceeds 3.0 or a case where a coefficient of variation of a number density of β-phase crystal grains distributed in the α phase exceeds 0.30. Therefore, the Fe content is 0.40% or less, and preferably 0.35% or less.

(O: 0.00 to 0.30%)

O is not an essential element, and is contained as an impurity, for example. O excessively increases the hardness to reduce the workability. Although O raises the hardness at a temperature around a room temperature, the reduction in hardness due to a temperature rise when performing the mirror polishing is larger when compared with Al, so O does not contribute very much to the hardness when performing the mirror polishing. For this reason, an O content is preferably as low as possible. In particular, when the O content exceeds 0.30%, the reduction in workability is significant. Therefore, the O content is 0.30% or less, and preferably 0.12% or less. The reduction in the O content requires a cost, and when the O content is tried to be reduced to less than 0.05%, the cost is significantly increased. For this reason, the O content may also be set to 0.05% or more.

(C: 0.00 to 0.10%)

C is not an essential element, and is contained as an impurity. C generates TiC and it reduces the specularity. For this reason, a C content is preferably as low as possible. In particular, when the C content exceeds 0.10%, the reduction in specularity is significant. Therefore, the C content is 0.10% or less, and preferably 0.08% or less. The reduction in the C content requires a cost, and when the C content is tried to be reduced to less than 0.0005%, the cost is significantly increased. For this reason, the C content may also be set to 0.0005% or more.

(Sn: 0.00 to 0.20%)

Although Sn is not an essential element, it suppresses the reduction in hardness due to the temperature rise during mirror polishing, particularly dry polishing, similarly to Al. Therefore, Sn may also be contained. In order to sufficiently obtain this effect, a Sn content is preferably 0.01% or more, and more preferably 0.03% or more. On the other hand, if the Sn content exceeds 0.20%, there is a possibility that an adverse effect is exerted on the workability. Therefore, the Sn content is 0.20% or less, and preferably 0.15% or less.

(Si: 0.00 to 0.15%)

Although Si is not an essential element, it suppresses the growth of crystal grains to improve the specularity, similarly to Fe. Further, Si is less likely to segregate than Fe. Therefore, Si may also be contained. In order to sufficiently obtain this effect, a Si content is preferably 0.01% or more, and more preferably 0.03% or more. On the other hand, if the Si content exceeds 0.15%, there is a possibility that an adverse effect is exerted on the specularity due to the segregation of Si. Therefore, the Si content is 0.15% or less, and preferably 0.12% or less.

(Balance: Ti and Impurities)

The balance is composed of Ti and impurities. As the impurities, there can be exemplified those contained in raw materials such as ore and scrap, and those contained in a manufacturing process such as, for example, C, N, H, Cr, Ni, Cu, V, and Mo. The total amount of these C, N, H, Cr, Ni, Cu, V, and Mo is desirably 0.4% or less.

[Microstructure]

Next, a microstructure of the titanium alloy part according to the present embodiment will be described in detail. The titanium alloy part according to the present embodiment has a metal microstructure in which a β phase is distributed in a parent phase of α phase, and is desirably an α-β-type titanium alloy (two-phase microstructure) with an α-phase area ratio of 90% or more. In the present embodiment, an average grain diameter of α-phase crystal grains is 15.0 μm or less, an average aspect ratio of the α-phase crystal grains is 1.0 or more and 3.0 or less, and a coefficient of variation of a number density of β-phase crystal grains distributed in the α phase is 0.30 or less.

(Average Grain Diameter of α-Phase Crystal Grains: 15.0 μm or Less)

If the average grain diameter of the α-phase crystal grains exceeds 15.0 μm, an unevenness become larger, and it is not possible to obtain the excellent specularity. Therefore, the average grain diameter of the α-phase crystal grains is 15.0 μm or less, and preferably 12.0 μm or less. The average grain diameter of the α-phase crystal grains can be obtained, for example, through a line segment method from an optical micrograph photographed by using a sample for metal microstructure observation. For example, an optical micrograph of 300 μm×200 μm photographed at 200 magnifications is prepared, and five line segments are drawn vertically and horizontally, respectively, on this optical micrograph. For each line segment, an average grain diameter is calculated by using the number of crystal grain boundaries of α-phase crystal grains crossing the line segment, and an arithmetic mean value of the average grain diameter corresponding to ten line segments in total is used to be set as the average grain diameter of the α-phase crystal grains. Note that when counting the number of crystal grain boundaries, it is set that the number of twin boundaries is not included. Further, when performing the photographing, by etching the mirror-polished sample cross section with a mixed solution of hydrofluoric acid and nitric acid, the α phase exhibits a white color and the β phase exhibits a black color, so that it is possible to easily distinguish the α phase and the β phase. Note that it is also possible to distinguish the α phase and the β phase through EPMA by utilizing a property that Fe is concentrated in the β phase. For example, a region where the intensity of Fe is 1.5 times or more when compared with the α phase being the parent phase, can be judged as the β phase.

(Average Number of Deformation Twins Per α-Phase Crystal Grain: 2.0 or More and 10.0 or Less)

At an interface between the parent phase and the twin crystal (twin boundary), there is a surface of discontinuity of crystals similar to the crystal grain boundary, so that as the number of existing twin crystals is larger, it is more likely to practically obtain an effect same as that of a case where the crystal grain diameter becomes small Specifically, the unevenness during polishing becomes smaller, and thus the excellent specularity can be obtained. When the average number of deformation twins per α-phase crystal grain is 2.0 or less, a remarkable effect cannot be obtained. For this reason, the average number of deformation twins per α-phase crystal grain is preferably 2.0 or more, and more preferably 3.0 or more. On the other hand, when the average number of deformation twins per α-phase crystal grain exceeds 10.0, the hardness becomes excessively high, which reduces the workability. For this reason, the average number of deformation twins per α-phase crystal grain is preferably 10.0 or less, and more preferably 8.0 or less. Note that when measuring the number of deformation twins, an optical micrograph of a field of view of 120 μm×80 μm arbitrarily selected from a sample for metal microstructure observation is prepared, and by setting all α-phase crystal grains observed within the field of view as targets, the number of deformation twins is counted. An arithmetic mean value thereof is used to determine the average number of deformation twins per α-phase crystal grain.

(Average Aspect Ratio of α-Phase Crystal Grains: 1.0 or More and 3.0 or Less)

An aspect ratio of an α-phase crystal grain is a quotient obtained by dividing a length of a major axis of the α-phase crystal grain by a length of a minor axis. Here, the "major axis" indicates a line segment having the maximum length out of line segments each connecting arbitrary two points on a grain boundary (contour) of the α-phase crystal grain, and the "minor axis" indicates a line segment having the maximum length out of line segments each being normal to the major axis and connecting arbitrary two points on the grain boundary (contour). If the average aspect ratio of the α-phase crystal grains exceeds 4.0, an unevenness associated with the α-phase crystal grains having a high shape anisotropy is likely to be noticeable, resulting in that the excellent specularity cannot be obtained. Therefore, the average aspect ratio of the α-phase crystal grains is 3.0 or less, and preferably 2.5 or less. Further, when the major axis and the minor axis are equal, the aspect ratio becomes 1.0. The aspect ratio never becomes less than 1.0 by definition thereof. Note that since the titanium alloy part is manufactured through hot forging, the average aspect ratio of the α-phase crystal grains may have a non-negligible difference depending on a cross section where the microstructure is observed. For this reason, as the average aspect ratio of the α-phase crystal grains, an average value among three cross sections which are orthogonal to one another is used. The average aspect ratio for each cross section is obtained in a manner that 50 α-phase crystal grains are extracted from a cross section with the maximum area within an optical micrograph of 300 μm×200 μm photographed at 200 magnifications, for example, and an average value of aspect ratios thereof is calculated.

Figure 2:
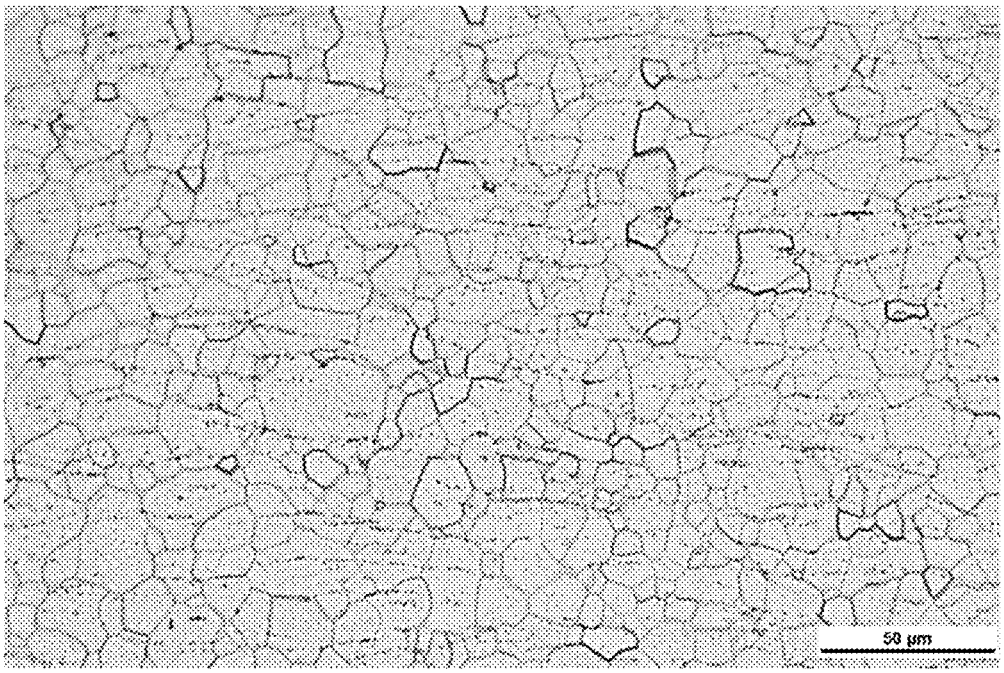
FIG. 2 is an optical micrograph indicating an α-phase microstructure of a titanium alloy part according to the present embodiment.

FIG. 1 illustrates an optical micrograph of an α-phase microstructure in an α+β-type two-phase alloy formed of an acicular microstructure, and FIG. 2 illustrates an optical micrograph indicating an α-phase microstructure of a titanium alloy part according to the present embodiment. In the acicular microstructure, an unevenness is likely to be noticeable, and thus the excellent specularity cannot be obtained. The α-phase crystal grains in the titanium alloy part according to the present embodiment has an average aspect ratio of 3.0 or less in order to be distinguished from the acicular microstructure.

(Coefficient of Variation of Number Density of β-Phase Crystal Grains Distributed in α Phase: 0.30 or Less)

Figure 3:
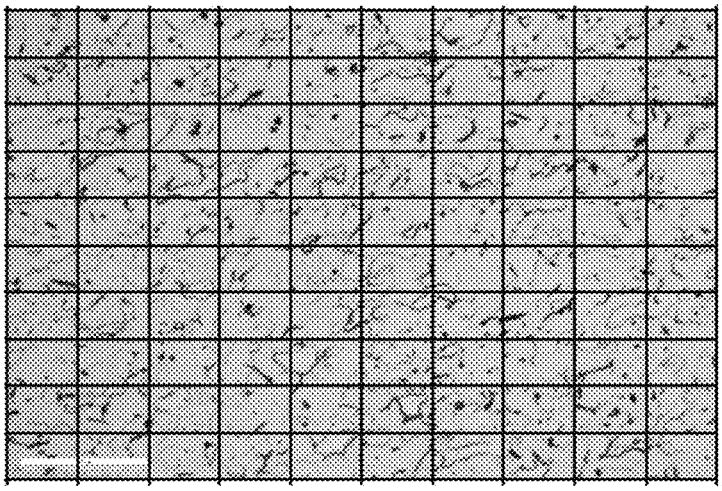
FIG. 3 is an optical micrograph for explaining uniformity of a β-phase distribution (uniform dispersion of β grains) in the α-phase microstructure of the titanium alloy part according to the embodiment of the present invention.
Figure 4:
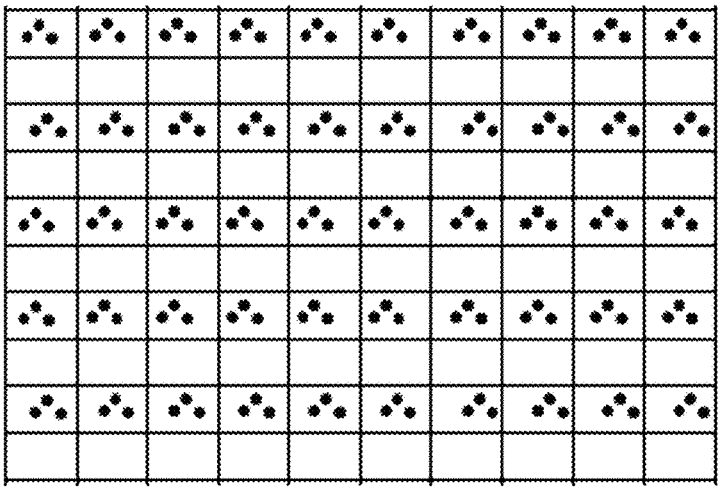
FIG. 4 is a schematic view illustrating a case where a Ti hot-rolled sheet is supposed and β grains are distributed in layers.
Figure 5:
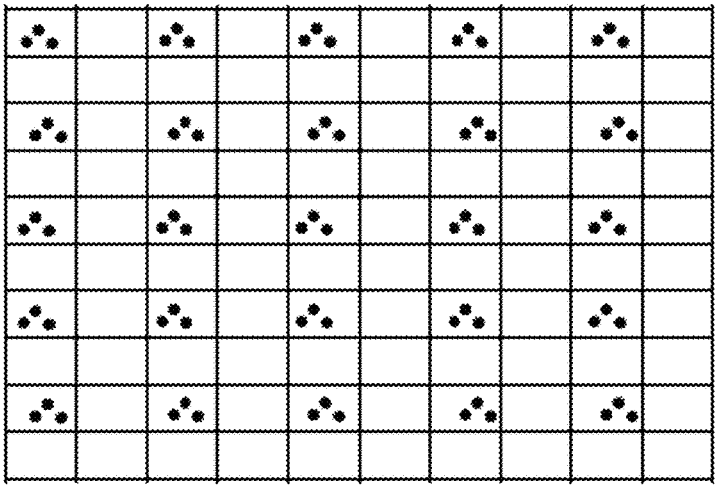
FIG. 5 is a schematic view illustrating a case where β grains are locally concentrated.

Here, the way of determining the coefficient of variation of the number density of the β-phase crystal grains distributed in the α phase will be described while referring to FIG. 3 to FIG. 5. FIG. 3 is an optical micrograph for explaining uniformity of a β-phase distribution (uniform dispersion of β grains) in the α-phase microstructure of the titanium alloy part according to the embodiment of the invention, in which the coefficient of variation of the number density of the β-phase crystal grains is 0.30 or less. FIG. 4 is a schematic view illustrating a case where a Ti hot-rolled sheet is supposed and β grains are distributed in layers, in which the β-phase crystal grains are distributed in layers, and the coefficient of variation of the number density of the β-phase crystal grains is 1.0. FIG. 5 is a schematic view illustrating a case where β grains are locally concentrated, in which the coefficient of variation of the number density of the β-phase crystal grains is about 1.7.

Figure 6:
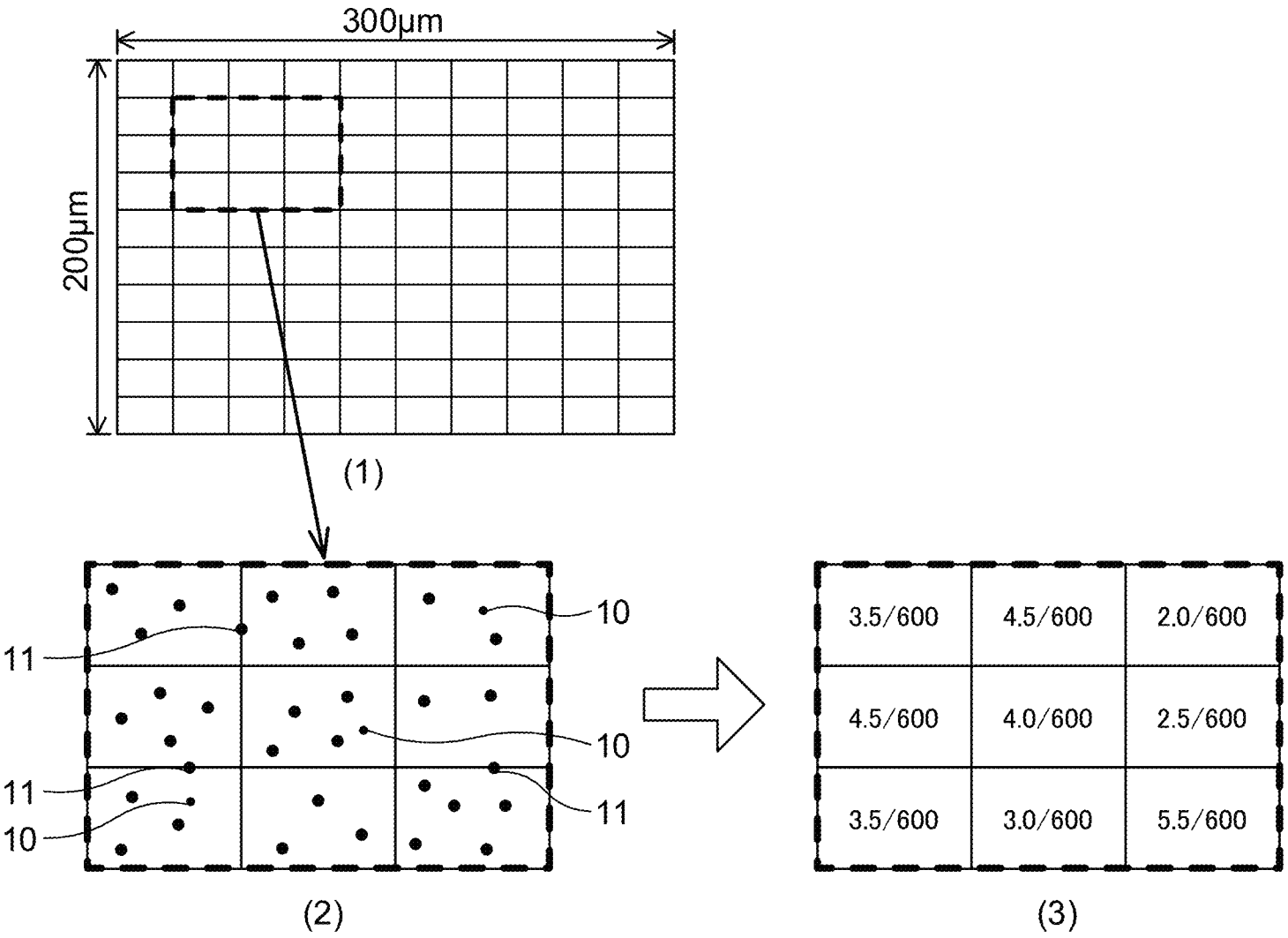
FIG. 6 are explanatory views illustrating a procedure of calculating a coefficient of variation of a number density of β-phase crystal grains.

The coefficient of variation of the number density of the β-phase crystal grains distributed in the α phase is an index indicating the uniformity of the β-phase distribution, and is calculated as follows. First, as illustrated in FIG. 6(1), an optical micrograph of 300 μm (horizontal direction)×200 μm (vertical direction) photographed at 200 magnifications is vertically divided into 10 equal parts and horizontally divided into 10 equal parts, to be divided into 100 squares. Next, the number density of β grains for each square (a value obtained by dividing the number of β grains existing in each square by an area of the square) is determined. At this time, the β grain having a circle-equivalent diameter of 0.5 μm or more is targeted, and the β grain which exists across two or more squares is counted such that 0.5 pieces of the β grain exists in each of the squares. For example, as illustrated in FIG. 6(2), in enlarged vertical and horizontal 3×3 squares, a β grain 10 having a circle-equivalent diameter of less than 0.5 μm is inferior regarding an effect of improving the specularity, and thus it is not counted as the number of β grains. Further, a β grain 11 which exists across two squares is counted such that 0.5 pieces thereof exists in each of the squares. For example, the number density (number/$\mu m^2$) of β grains in each square of the vertical and horizontal 3×3 squares illustrated in an enlarged manner in FIG. 6(2) is as illustrated in FIG. 6(3). After that, an arithmetic average and a standard deviation of the number density of β grains among 100 squares illustrated in FIG. 6(1) are calculated. Subsequently, a quotient obtained by dividing the standard deviation by the arithmetic average is employed as the coefficient of variation of the number density of the β-phase crystal grains distributed in the α phase. If the coefficient of variation of the number density of the β-phase crystal grains distributed in the α phase exceeds 0.30, an unevenness is likely to occur during the mirror polishing due to the nonuniformity of the β-phase distribution, resulting in that the excellent specularity cannot be obtained. Therefore, the coefficient of variation of the number density of the β-phase crystal grains distributed in the α phase is 0.30 or less, and preferably 0.25 or less.

[Manufacturing Method]

Next, one example of a manufacturing method of the titanium alloy part according to the embodiment of the present invention will be described. Note that the manufacturing method to be described below is one example for obtaining the titanium alloy part according to the embodiment of the present invention, and the titanium alloy part according to the embodiment of the present invention is not limited to be manufactured by the following manufacturing method. In this manufacturing method, first, a titanium alloy raw material having the aforementioned chemical composition is subjected to hot rolling, and cooling to the room temperature, to thereby obtain a hot-rolled material. Next, the hot-rolled material is subjected to annealing, and cooling to the room temperature, to thereby obtain a hot-rolled annealed material. After that, the hot-rolled annealed material is subjected to size adjustment, scale removal, and hot forging. The hot forging is repeated 2 to 10 times, and cooling is performed to the room temperature every time the hot forging is performed. Subsequently, machining and mirror polishing are carried out. According to such a method, it is possible to manufacture the titanium alloy part according to the embodiment of the present invention.

(Hot Rolling)

The titanium alloy raw material can be obtained through, for example, melting of the raw material, casting, and forging. The hot rolling is started in a two-phase region of α and β (a temperature region lower than a β transformation temperature $T_{\beta100}$). By performing the hot rolling in the two-phase region, a c-axis of hexagonal close-packed (hcp) is oriented in a direction normal to a surface of the hot-rolled annealed material, resulting in that an in-plane anisotropy becomes small. The reduction in anisotropy is quite effective for improving the specularity. If the hot rolling is started at the β transformation temperature $T_{\beta100}$ or a temperature higher than the β transformation temperature $T_{\beta100}$, a proportion of the acicular microstructure become high, and it is not possible to obtain the α-phase crystal grain having the aspect ratio whose average value is 1.0 or more and 3.0 or less.

(Annealing)

The annealing of the hot-rolled material is performed under a condition in a temperature region of 600° C. or more and equal to or less than a temperature $T_{\beta20}$ at which a β-phase fraction becomes 20%, for 30 minutes or more and 240 minutes or less. If the annealing temperature is less than 600° C., recrystallization cannot be completed by the annealing, resulting in that a worked structure remains, and the average aspect ratio of the α-phase crystal grains exceeds 3.0 or a worked microstructure with nonuniform β-phase distribution remains, which makes it impossible to obtain the excellent specularity. On the other hand, if the annealing temperature exceeds the temperature $T_{\beta20}$, the proportion of the acicular microstructure becomes high, resulting in that the average aspect ratio of the α-phase crystal grains exceeds 3.0 or the coefficient of variation of the number density of the β-phase crystal grains exceeds 0.3. Further, there is a possibility that the average grain diameter of the α-phase crystal grains exceeds 15.0 μm. If the annealing time is less than 30 minutes, the recrystallization cannot be completed by the annealing, resulting in that a worked microstructure remains, and the average aspect ratio of the α-phase crystal grains exceeds 3.0 or a worked microstructure with nonuniform β-phase distribution remains, which makes it impossible to obtain the excellent specularity. If the annealing time exceeds 240 minutes, the average grain diameter of the α-phase crystal grains exceeds 15.0 μm, and it is not possible to obtain the excellent specularity. Further, as the period of time of the annealing becomes longer, the scale becomes thicker and the yield becomes lower.

(Size Adjustment, Scale Removal)

The hot-rolled annealed material is worked into a size suitable for a die used for the hot forging. For example, a blank material is cut out from the hot-rolled annealed material in a thick plate shape, or wire drawing or rolling of the hot-rolled annealed material in a round bar shape is performed. After that, pickling or machining is performed to remove scale that exists on a rolled surface of the hot-rolled annealed material. It is also possible to remove the scale by performing both pickling and machining (Hot Forging)

Basically, the average grain diameter and the average aspect ratio of the α-phase crystal grains can satisfy the present invention by performing the predetermined annealing, but, the coefficient of variation of the number density of the β-phase crystal grains does not satisfy the present invention without performing the hot forging. If a temperature of the hot forging is less than 750° C., a deformation resistance of the material is large, which facilitates breakage and wear of a tool. On the other hand, if the temperature of the hot forging exceeds the temperature $T_{\beta20}$, the proportion of the acicular microstructure becomes high, and the average value of the aspect ratio of the α-phase crystal grains exceeds 3.0 or the coefficient of variation of the number density of the β-phase crystal grains exceeds 0.3. As the number of times of forging is larger, the β-phase distribution is more likely to be uniform, and the aspect ratio of the α-phase crystal grains is more likely to be reduced.

The β transformation temperature $T_{\beta100}$ and the temperature $T_{\beta20}$ at which the β-phase fraction becomes 20% can be obtained from α phase diagram. The phase diagram can be obtained through, for example, a CALPHAD (Computer Coupling of Phase Diagrams and Thermochemistry) method, and for the purpose thereof, for example, it is possible to use Thermo-Calc which is an integrated thermodynamic calculation system provided by Thermo-Calc Software AB and a predetermined database (TI3).

After the hot forging, cooling to the room temperature is performed. At that time, if an average cooling rate from the forging temperature to 500° C. is less than 20° C./s, the β phase is generated during the cooling, and in heating to be performed thereafter, the β-phase distribution is difficult to be uniform, and it is not possible to make the coefficient of variation of the number density of the β-phase crystal grains to be 0.3 or less. Further, Al and Fe diffuse during the cooling, which causes a heterogeneity of their concentrations, and which also causes an unevenness of a surface state after mirror polishing. An average cooling rate when performing water quench is approximately 300° C./s, although depending also on a size of an object. An average cooling rate when performing air cooling is approximately 3° C./s, so that it is preferable to perform the water quench.

Further, the hot forging and the cooling to the room temperature are repeatedly performed. If the forging is performed only one time, it is sometimes impossible to make the coefficient of variation of the number density of the β-phase crystal grains to be 0.3 or less, or to make the average aspect ratio of the α-phase crystal grains to be 3.0 or less. On the other hand, even if the forging and the cooling are repeated 11 times or more, the change in the microstructure is small, which may unnecessarily cause the reduction in yield and the increase in manufacturing cost. The β phase is uniformly distributed during reheating after the cooling.

In order to make the average number of deformation twins per α-phase crystal grain to be 2.0 or more, there is a need to set the maximum reduction of area at the time of final forging to 0.10 or more. On the other hand, in order to make the average number of deformation twins per α-phase crystal grain to be 10.0 or less, there is a need to set the maximum reduction of area at the time of final forging to 0.50 or less. Here, the reduction of area can be calculated by $\{(A_1-A_2)/A_1\}$ from a cross-sectional area $A_1$ before forging and a cross-sectional area $A_2$ after forging in a certain cross section of the material. In the present invention, out of cross sections parallel to a compressing direction of the final forging, a reduction of area in a cross section with the largest reduction of area is set to the maximum reduction of area.

The titanium alloy part according to the embodiment of the present invention can be manufactured by the above-described manufacturing method as one example. The titanium alloy part according to the embodiment of the present invention manufactured as above is subsequently subjected to machining and mirror polishing as follows, and can be manufactured into various products and components excellent in appearance such as ornaments.

(Machining)

The titanium alloy part according to the embodiment of the present invention manufactured as above is subjected to machining such as cutting, for example. In the machining, for example, drilling for connecting mutual components of an ornament is performed.

(Mirror Polishing)

Further, for example, the mirror polishing is performed after the machining Although either wet polishing or dry polishing may be performed, from a viewpoint of suppression of sagging, the dry polishing is more preferable than the wet polishing. In the dry polishing, a temperature is likely to be higher than that in the wet polishing, but, in the present embodiment, since an appropriate amount of Al is contained, a reduction in hardness due to the temperature rise is suppressed. Although a concrete method of the mirror polishing is not particularly defined, it is performed while properly using, for example, a polishing wheel of hemp base, grass base, cloth base, and the like, and a sand paper depending on purposes.

By performing the machining and the minor polishing on the titanium alloy part according to the embodiment of the present invention as described above, it is possible to obtain various products and components excellent in appearance such as ornaments.

[Evaluation]

The titanium alloy part according to the embodiment of the present invention is evaluated as follows regarding its good workability and excellent specularity.

(Vickers Hardness Hv5.0)

The titanium alloy part according to the embodiment of the present invention having the Vickers hardness Hv5.0 of 200 or more and 400 or less as an index of evaluating the good workability, is set as acceptable. If the Vickers hardness Hv5.0 is less than 200, the sufficient hardness cannot be obtained during the mirror polishing, and it is not possible to obtain the excellent specularity. On the other hand, if the Vickers hardness Hv5.0 exceeds 400, a total elongation often becomes less than 10%, which deteriorates the workability. The measurement of Vickers hardness is performed according to JIS Z 2244, in which a test is performed on seven points with a measuring load of 5 kgf and a retention time of 15 s, and calculation is performed based on an average of five points excluding the maximum value and the minimum value. Further, the Vickers hardness is measured in a manner that, for example, a forged product is cut and polished to produce a flat surface, and it is set that a distance between centers of two adjacent indentations on the flat surface becomes larger by five times or more than an indentation size.

(DOI)

Further, as an index of evaluating the excellent specularity, DOI (Distinctness of Image) being a parameter representing image clarity is used. The measurement of DOI is performed according to ASTM D 5767 with an angle of incident light of 20°. The DOI is measured by using, for example, an appearance analyzer Rhopoint IQ Flex 20 manufactured by Rhopoint Instruments, or the like. The higher the DOI, the better the specularity, and the DOI of 60 or more is set as acceptable.

Note that each of the above-described embodiments only shows concrete examples when implementing the present invention, and the technical scope of the present invention should not be limitedly construed by these. That is, the present invention can be implemented in various forms without departing from the technical idea or the main features thereof.

EXAMPLES

Next, examples of the present invention will be described. The conditions in the examples are one condition example adopted to confirm the practicability and effects of the present invention, and the present invention is not limited to the one condition example. The present invention can adopt various conditions as long as the object of the present invention is achieved without departing from the gist of the present invention.

In the examples, a plurality of raw materials having chemical compositions shown in Table 1 were prepared. A blank column in Table 1 indicates that a content of an element in that column was less than a detection limit, and a balance is composed of Ti and impurities. An underline in Table 1 indicates that the underlined numeric value is out of the range of the present invention.

TABLE 1

| RAW | CHEMICAL COMPOSITION (MASS %) | | | | | |
|---|---|---|---|---|---|---|
| MATERIAL | Al | Fe | O | C | Sn | Si |
| A | 3.0 | 0.2 | 0.05 | 0.02 | | |
| B | 2.0 | 0.4 | 0.10 | 0.02 | | |
| C | 2.0 | 0.2 | 0.10 | 0.01 | | |
| D | 2.5 | 0.2 | 0.10 | 0.03 | | |
| E | 3.0 | 0.2 | 0.10 | 0.04 | | |
| F | 2.0 | 0.3 | 0.13 | 0.03 | | |
| G | 1.5 | 0.1 | 0.15 | 0.02 | | |
| H | 3.5 | 0.2 | 0.07 | 0.01 | | |
| I | 2.5 | 0.1 | 0.10 | 0.03 | | |
| J | 1.0 | 0.3 | 0.15 | 0.01 | | |
| K | 3.0 | 0.3 | 0.14 | 0.01 | | |
| L | 1.5 | 0.2 | 0.08 | 0.01 | | |
| M | 2.0 | 0.2 | 0.10 | 0.01 | 0.01 | |
| N | 2.0 | 0.2 | 0.10 | 0.03 | 0.10 | |
| O | 2.0 | 0.2 | 0.10 | 0.04 | | 0.01 |
| P | 2.0 | 0.2 | 0.10 | 0.03 | | 0.10 |
| Q | 2.0 | 0.2 | 0.10 | 0.02 | 0.10 | 0.10 |
| R | 4.0 | 0.2 | 0.10 | 0.01 | | |
| S | 4.4 | 0.4 | 0.10 | 0.02 | | |
| T | 3.5 | 0.1 | 0.13 | 0.02 | | |
| U | 1.0 | 0.4 | 0.10 | 0.02 | | |
| V | 2.0 | 0.2 | 0.10 | 0.03 | 0.12 | |
| W | 2.0 | 0.2 | 0.10 | 0.02 | | 0.12 |
| X | 5.0 | 0.3 | 0.10 | 0.03 | | |
| Y | 6.5 | 0.3 | 0.09 | 0.02 | | |

TABLE 1-continued

| RAW MATERIAL | CHEMICAL COMPOSITION (MASS %) Al | Fe | O | C | Sn | Si |
|---|---|---|---|---|---|---|
| Z | 7.8 | 0.2 | 0.10 | 0.02 | | |
| AA | 4.5 | 0.4 | 0.25 | 0.02 | | |
| BB | 5.5 | 0.2 | 0.20 | 0.03 | | |
| CC | 4.5 | 0.2 | 0.28 | 0.02 | | |
| DD | 6.5 | 0.3 | 0.35 | 0.03 | | |
| EE | 0.5 | 0.4 | 0.15 | 0.02 | | |
| FF | 1.0 | 0.01 | 0.14 | 0.03 | | |
| GG | 4.0 | 0.01 | 0.10 | 0.02 | | |
| HH | 1.0 | 1.0 | 0.10 | 0.01 | | |
| II | 1.0 | 0.01 | 0.20 | 0.03 | | |
| JJ | 5.0 | 1.0 | 0.07 | 0.04 | | |
| KK | 5.0 | 0.01 | 0.11 | 0.03 | | |
| LL | 0.0 | 0.4 | 0.30 | 0.03 | | |
| MM | 4.0 | 0.01 | 0.25 | 0.03 | | |
| NN | 2.0 | 0.2 | 0.10 | 0.17 | | |
| OO | 2.5 | 0.3 | 0.10 | 0.04 | | |
| PP | 1.5 | 0.2 | 0.10 | 0.01 | | |
| QQ | 8.5 | 0.3 | 0.20 | 0.04 | | |

TABLE 1-continued

| RAW MATERIAL | CHEMICAL COMPOSITION (MASS %) Al | Fe | O | C | Sn | Si |
|---|---|---|---|---|---|---|
| RR | 1.5 | 0.6 | 0.09 | 0.03 | | |
| SS | 7.8 | 0.2 | 0.20 | 0.02 | 0.25 | |
| TT | 2.0 | 0.2 | 0.10 | 0.03 | | 0.18 |

Next, each of the raw materials was subjected to hot rolling, annealing, and hot forging under conditions shown in Tables 2-1 and 2-2 to produce an evaluation sample simulating a shape of an ornament (brooch), and after that, dry polishing was performed. The dry polishing was performed in the order from polishing with a rough-grid abrasive paper to polishing with a fine-grid abrasive paper, and after that, finishing was performed through buffing to obtain a mirror surface. An underline in Tables 2-1 and 2-2 indicates that the underlined condition is out of the range suitable for manufacturing the titanium alloy part according to the present invention.

TABLE 2-1

| | RAW MATERIAL | MANUFACTURING METHOD | | | | | | | | | |
|---|---|---|---|---|---|---|---|---|---|---|---|
| | | TEMPERATURE $T_{\beta 20}$ AT WHICH β FRACTION BECOMES 20% (° C.) | β TRANSFORMATION TEMPERATURE $T_{\beta 100}$ (° C.) | HOT ROLLING TEMPER-ATURE (° C.) | ANNEALING TEMPERATURE (° C.) | ANNEALING TIME (min) | FORGING TEMPER-ATURE (° C.) | THE NUMBER OF TIMES OF FORGING | COOLING RATE AFTER FORGING (° C./s)/COOLING METHOD | MAXIMUM REDUCTION OF AREA IN FINAL FORGING | OTHER PROCESSES |
| EXAMPLE 1 | A | 920 | 960 | 850 | 890 | 120 | 880 | 6 | 300/WATER QUENCH | 0.14 | — |
| EXAMPLE 2 | B | 883 | 940 | 700 | 840 | 60 | 850 | 6 | 300/WATER QUENCH | 0.43 | — |
| EXAMPLE 3 | C | 904 | 948 | 750 | 750 | 60 | 850 | 8 | 300/WATER QUENCH | 0.33 | — |
| EXAMPLE 4 | D | 914 | 961 | 780 | 800 | 120 | 850 | 8 | 300/WATER QUENCH | 0.38 | — |
| EXAMPLE 5 | E | 923 | 972 | 800 | 850 | 60 | 900 | 8 | 300/WATER QUENCH | 0.34 | — |
| EXAMPLE 6 | F | 895 | 951 | 750 | 850 | 30 | 850 | 6 | 300/WATER QUENCH | 0.27 | — |
| EXAMPLE 7 | G | 909 | 945 | 850 | 800 | 60 | 890 | 6 | 300/WATER QUENCH | 0.21 | — |
| EXAMPLE 8 | H | 931 | 978 | 900 | 875 | 240 | 900 | 7 | 300/WATER QUENCH | 0.25 | — |
| EXAMPLE 9 | I | 926 | 962 | 950 | 920 | 60 | 850 | 6 | 300/WATER QUENCH | 0.24 | — |
| EXAMPLE 10 | J | 878 | 927 | 700 | 600 | 120 | 750 | 6 | 300/WATER QUENCH | 0.19 | — |
| EXAMPLE 11 | K | 913 | 969 | 880 | 850 | 180 | 880 | 10 | 300/WATER QUENCH | 0.15 | — |
| EXAMPLE 12 | L | 894 | 932 | 900 | 700 | 120 | 860 | 2 | 300/WATER QUENCH | 0.44 | — |
| EXAMPLE 13 | M | 905 | 948 | 800 | 750 | 120 | 850 | 5 | 300/WATER QUENCH | 0.19 | — |
| EXAMPLE 14 | N | 905 | 949 | 800 | 750 | 120 | 850 | 5 | 300/WATER QUENCH | 0.11 | — |
| EXAMPLE 15 | O | 905 | 948 | 800 | 750 | 120 | 850 | 5 | 300/WATER QUENCH | 0.13 | — |
| EXAMPLE 16 | P | 903 | 948 | 800 | 750 | 120 | 850 | 5 | 300/WATER QUENCH | 0.21 | — |
| EXAMPLE 17 | Q | 903 | 948 | 800 | 750 | 120 | 850 | 5 | 300/WATER QUENCH | 0.29 | — |
| EXAMPLE 18 | R | 943 | 990 | 900 | 850 | 240 | 900 | 10 | 300/WATER QUENCH | 0.30 | — |
| EXAMPLE 19 | S | 918 | 994 | 900 | 800 | 240 | 880 | 10 | 300/WATER QUENCH | 0.12 | — |
| EXAMPLE 20 | T | 947 | 991 | 800 | 800 | 120 | 920 | 10 | 300/WATER QUENCH | 0.49 | — |
| EXAMPLE 21 | U | 869 | 918 | 700 | 700 | 180 | 750 | 4 | 300/WATER QUENCH | 0.27 | — |
| EXAMPLE 22 | V | 905 | 949 | 850 | 750 | 180 | 800 | 4 | 300/WATER QUENCH | 0.42 | — |
| EXAMPLE 23 | W | 903 | 948 | 850 | 750 | 120 | 780 | 5 | 300/WATER QUENCH | 0.15 | — |
| EXAMPLE 24 | X | 950 | 1008 | 950 | 920 | 120 | 900 | 8 | 300/WATER QUENCH | 0.18 | — |
| EXAMPLE 25 | Y | 979 | 1044 | 1000 | 950 | 240 | 950 | 10 | 300/WATER QUENCH | 0.11 | — |
| EXAMPLE 26 | Z | 1017 | 1074 | 1030 | 1000 | 240 | 1000 | 10 | 300/WATER QUENCH | 0.12 | — |
| EXAMPLE 27 | D | 914 | 961 | 780 | 800 | 120 | 850 | 8 | 300/WATER QUENCH | 0.07 | — |
| EXAMPLE 28 | Z | 1017 | 1074 | 1030 | 1000 | 240 | 1010 | 8 | 300/WATER QUENCH | 0.55 | — |
| EXAMPLE 29 | AA | 930 | 1024 | 900 | 850 | 180 | 900 | 10 | 300/WATER QUENCH | 0.12 | — |
| EXAMPLE 30 | BB | 982 | 1050 | 950 | 900 | 240 | 950 | 8 | 200/WATER QUENCH | 0.13 | — |
| EXAMPLE 31 | BB | 982 | 1050 | 950 | 900 | 240 | 950 | 8 | 50/WATER QUENCH | 0.12 | — |
| EXAMPLE 32 | CC | 969 | 1044 | 950 | 900 | 180 | 950 | 8 | 100/WATER QUENCH | 0.15 | — |

TABLE 2-2

| | RAW MATERIAL | MANUFACTURING METHOD | | | | | | | | | |
|---|---|---|---|---|---|---|---|---|---|---|---|
| | | TEMPERATURE $T_{\beta 20}$ AT WHICH β FRACTION BECOMES 20% (° C.) | β TRANS-FORMATION TEMPER-ATURE $T_{\beta 100}$ (° C.) | HOT ROLLING TEMPER-ATURE (° C.) | ANNEALING TEMPER-ATURE (° C.) | ANNEALING TIME (min) | FORGING TEMPER-ATURE (° C.) | THE NUMBER OF TIMES OF FORGING | COOLING RATE AFTER FORGING (° C./s)/COOLING METHOD | MAXIMUM REDUCTION OF AREA IN FINAL FORGING | OTHER PROCESSES |
| COMPARATIVE EXAMPLE 1 | DD | 1005 | 1105 | 1050 | 950 | 240 | 950 | 10 | 300/WATER QUENCH | 0.11 | — |
| COMPARATIVE EXAMPLE 2 | EE | 857 | 910 | 700 | 600 | 120 | 800 | 2 | 300/WATER QUENCH | 0.33 | — |
| COMPARATIVE EXAMPLE 3 | FF | 908 | 927 | 850 | 800 | 240 | 880 | 6 | 300/WATER QUENCH | 0.17 | — |
| COMPARATIVE EXAMPLE 4 | GG | 956 | 995 | 900 | 900 | 120 | 920 | 8 | 300/WATER QUENCH | 0.22 | — |
| COMPARATIVE EXAMPLE 5 | HH | 803 | 905 | 800 | 750 | 60 | 840 | 8 | 300/WATER QUENCH | 0.43 | — |
| COMPARATIVE EXAMPLE 6 | II | 911 | 936 | 700 | 700 | 120 | 840 | 4 | 300/WATER QUENCH | 0.14 | — |
| COMPARATIVE EXAMPLE 7 | JJ | 869 | 987 | 850 | 800 | 240 | 850 | 8 | 300/WATER QUENCH | 0.12 | — |
| COMPARATIVE EXAMPLE 8 | KK | 986 | 1021 | 900 | 900 | 120 | 960 | 10 | 300/WATER QUENCH | 0.28 | — |
| COMPARATIVE EXAMPLE 9 | LL | 856 | 915 | 700 | 650 | 180 | 850 | 8 | 300/WATER QUENCH | 0.36 | — |
| COMPARATIVE EXAMPLE 10 | MM | 978 | 995 | 900 | 850 | 180 | 940 | 10 | 300/WATER QUENCH | 0.21 | — |
| COMPARATIVE EXAMPLE 11 | NN | 920 | 1021 | 900 | 800 | 120 | 800 | 6 | 300/WATER QUENCH | 0.15 | — |
| COMPARATIVE EXAMPLE 12 | OO | 903 | 958 | 1000 | 750 | 120 | 800 | 4 | 300/WATER QUENCH | 0.20 | — |
| COMPARATIVE EXAMPLE 13 | OO | 903 | 958 | 850 | 550 | 60 | 800 | 4 | 300/WATER QUENCH | 0.20 | — |
| COMPARATIVE EXAMPLE 14 | OO | 903 | 958 | 850 | 930 | 60 | 800 | 4 | 300/WATER QUENCH | 0.19 | — |
| COMPARATIVE EXAMPLE 15 | OO | 903 | 958 | 850 | 700 | 20 | 800 | 4 | 300/WATER QUENCH | 0.22 | — |
| COMPARATIVE EXAMPLE 16 | OO | 903 | 958 | 850 | 700 | 300 | 800 | 4 | 300/WATER QUENCH | 0.18 | — |
| COMPARATIVE EXAMPLE 17 | OO | 903 | 958 | 850 | 700 | 60 | 700 | 4 | 300/WATER QUENCH | 0.21 | — |
| COMPARATIVE EXAMPLE 18 | OO | 903 | 958 | 850 | 700 | 60 | 930 | 4 | 300/WATER QUENCH | 0.20 | — |
| COMPARATIVE EXAMPLE 19 | OO | 903 | 958 | 850 | 700 | 60 | 800 | 1 | 300/WATER QUENCH | 0.45 | — |
| COMPARATIVE EXAMPLE 20 | OO | 903 | 958 | 850 | 700 | 60 | 800 | 4 | 3/AIR COOLING | 0.20 | — |
| COMPARATIVE EXAMPLE 21 | OO | 903 | 958 | 850 | 700 | 60 | — | — | — | — | — |
| COMPARATIVE | PP | 895 | 931 | 850 | 700 | 60 | — | — | — | — | 75% COLD ROLLING + |

TABLE 2-2-continued

| | | MANUFACTURING METHOD | | | | | | | | | |
|---|---|---|---|---|---|---|---|---|---|---|---|
| | RAW MATERIAL | TEMPERATURE $T_{\beta 20}$ AT WHICH β FRACTION BECOMES 20% (° C.) | β TRANS-FORMATION TEMPER-ATURE $T_{\beta 100}$ (° C.) | HOT ROLLING TEMPER-ATURE (° C.) | ANNEALING TEMPER-ATURE (° C.) | ANNEALING TIME (min) | FORGING TEMPER-ATURE (° C.) | THE NUMBER OF TIMES OF FORGING | COOLING RATE AFTER FORGING (° C./s)/COOLING METHOD | MAXIMUM REDUCTION OF AREA IN FINAL FORGING | OTHER PROCESSES |
| EXAMPLE 22 | | | | | | | | | | | VACUUM ANNEALING |
| COMPARATIVE EXAMPLE 23 | QQ | 1024 | 1101 | 1000 | 950 | 240 | 1000 | 10 | 300/WATER QUENCH | 0.11 | — |
| COMPARATIVE EXAMPLE 24 | RR | 854 | 936 | 800 | 800 | 120 | 850 | 4 | 300/WATER QUENCH | 0.23 | — |
| COMPARATIVE EXAMPLE 25 | SS | 1024 | 1090 | 1000 | 950 | 120 | 1000 | 10 | 300/WATER QUENCH | 0.19 | — |
| COMPARATIVE | TT | 904 | 957 | 850 | 800 | 120 | 850 | 4 | 300/WATER QUENCH | 0.15 | |

Further, after the dry polishing, evaluation of the specularity was conducted. In the evaluation of the specularity, DOI (Distinctness of Image) being a parameter representing image clarity was used. The DOI measurement was performed according to ASTM D 5767 with an angle of incident light of 20°. The DOI can be measured by using, for example, an appearance analyzer Rhopoint IQ Flex 20 manufactured by Rhopoint Instruments, or the like. The higher the DOI, the better the specularity, and a sample with the DOI of 60 or more is set as an acceptable line of the specularity. Further, the part after being subjected to the evaluation of the specularity was cut at an arbitrary cross section, subjected to mirror polishing and etching, an optical micrograph was photographed. And by using this photograph, an average grain diameter of α-phase crystal grains, an average aspect ratio of the α-phase crystal grains, a coefficient of variation of a number density of β-phase crystal grains distributed in the α phase, and an average number of deformation twins per one crystal grain of the α phase were measured. Further, the hardness (Hv5.0) was measured through a Vickers hardness test.

Results of these are shown in Tables 3-1 and 3-2. An underline in Tables 3-1 and 3-2 indicates that the underlined numeric value is out of the range of the present invention or the underlined evaluation is out of the range to be obtained by the present invention. Note that in Tables 3-1 and 3-2, a grain diameter indicates an average grain diameter of α-phase crystal grains, an aspect ratio indicates an average aspect ratio of the α-phase crystal grains, and a coefficient of variation of β-grain density indicates a coefficient of variation of a number density of β-phase crystal grains.

TABLE 3-1

| | | METAL MICROSTRUCTURE | | | | | |
|---|---|---|---|---|---|---|---|
| | RAW MATERIAL | GRAIN DIAMETER (μm) | ASPECT RATIO | COEFFICIENT OF VARIATION OF β GRAIN DENSITY | THE AVERAGE NUMBER OF DEFORMATION TWINS PER ONE α-PHASE CRYSTAL GRAIN | SPECULARITY DOI (%) | WORKABILITY SURFACE HARDNESS (Hv5.0) |
| EXAMPLE 1 | A | 7.2 | 1.7 | 0.22 | 3.0 | 75 | 251 |
| EXAMPLE 2 | B | 8.6 | 1.6 | 0.18 | 6.9 | 69 | 218 |
| EXAMPLE 3 | C | 7.4 | 1.9 | 0.19 | 5.2 | 70 | 227 |
| EXAMPLE 4 | D | 8.5 | 1.8 | 0.24 | 5.7 | 71 | 235 |
| EXAMPLE 5 | E | 8.8 | 2.1 | 0.21 | 5.1 | 75 | 247 |
| EXAMPLE 6 | F | 7.9 | 2.1 | 0.19 | 3.7 | 72 | 229 |
| EXAMPLE 7 | G | 10.3 | 2.2 | 0.20 | 5.0 | 68 | 220 |
| EXAMPLE 8 | H | 6.8 | 1.7 | 0.23 | 3.5 | 81 | 247 |
| EXAMPLE 9 | I | 7.8 | 2.0 | 0.20 | 5.0 | 75 | 230 |
| EXAMPLE 10 | J | 11.2 | 2.3 | 0.19 | 5.1 | 62 | 210 |
| EXAMPLE 11 | K | 5.6 | 1.5 | 0.16 | 3.1 | 75 | 241 |
| EXAMPLE 12 | L | 9.4 | 2.8 | 0.28 | 7.6 | 67 | 232 |
| EXAMPLE 13 | M | 8.5 | 1.5 | 0.21 | 3.7 | 70 | 218 |
| EXAMPLE 14 | N | 8.6 | 2.2 | 0.23 | 2.9 | 69 | 220 |
| EXAMPLE 15 | O | 8.4 | 2.1 | 0.19 | 2.8 | 69 | 223 |
| EXAMPLE 16 | P | 8.2 | 1.9 | 0.18 | 4.2 | 72 | 221 |
| EXAMPLE 17 | Q | 7.8 | 2.2 | 0.22 | 4.9 | 70 | 223 |
| EXAMPLE 18 | R | 6.5 | 1.5 | 0.23 | 4.3 | 84 | 270 |
| EXAMPLE 19 | S | 6.4 | 1.8 | 0.26 | 2.4 | 90 | 267 |
| EXAMPLE 20 | T | 7.3 | 1.6 | 0.12 | 8.7 | 82 | 264 |
| EXAMPLE 21 | U | 8.9 | 1.5 | 0.18 | 6.4 | 63 | 200 |
| EXAMPLE 22 | V | 8.6 | 2.1 | 0.20 | 8.2 | 72 | 218 |
| EXAMPLE 23 | W | 8.9 | 2.2 | 0.26 | 3.2 | 68 | 218 |
| EXAMPLE 24 | X | 5.2 | 1.8 | 0.23 | 3.5 | 90 | 296 |
| EXAMPLE 25 | Y | 8.7 | 1.5 | 0.18 | 2.3 | 93 | 330 |
| EXAMPLE 26 | Z | 7.5 | 1.7 | 0.16 | 2.5 | 96 | 365 |
| EXAMPLE 27 | D | 8.5 | 1.8 | 0.24 | 1.8 | 63 | 206 |
| EXAMPLE 28 | Z | 7.2 | 2.2 | 0.22 | 10.5 | 97 | 397 |
| EXAMPLE 29 | AA | 13.6 | 2.5 | 0.26 | 2.3 | 75 | 319 |
| EXAMPLE 30 | BB | 8.0 | 1.7 | 0.16 | 2.4 | 90 | 338 |
| EXAMPLE 31 | BB | 8.2 | 1.7 | 0.19 | 2.5 | 88 | 338 |
| EXAMPLE 32 | CC | 9.4 | 2.0 | 0.18 | 2.4 | 85 | 337 |

TABLE 3-2

| | RAW MATERIAL | METAL MICROSTRUCTURE: GRAIN DIAMETER (μm) | ASPECT RATIO | COEFFICIENT OF VARIATION OF β GRAIN DENSITY | THE AVERAGE NUMBER OF DEFORMATION TWINS PER ONE α-PHASE CRYSTAL GRAIN | SPECULARITY DOI (%) | WORKABILITY SURFACE HARDNESS (Hv5.0) |
|---|---|---|---|---|---|---|---|
| COMPARATIVE EXAMPLE 1 | DD | 6.5 | 1.5 | 0.14 | 2.3 | 90 | 411 |
| COMPARATIVE EXAMPLE 2 | EE | 5.6 | 1.7 | 0.15 | 8.2 | 53 | 199 |
| COMPARATIVE EXAMPLE 3 | FF | 17.3 | 1.7 | 0.20 | 3.9 | 52 | 203 |
| COMPARATIVE EXAMPLE 4 | GG | 18.5 | 2.2 | 0.24 | 3.5 | 58 | 278 |
| COMPARATIVE EXAMPLE 5 | HH | 8.5 | 2.1 | 0.42 | 8.8 | 58 | 205 |
| COMPARATIVE EXAMPLE 6 | II | 21.5 | 1.8 | 0.17 | 3.1 | 54 | 222 |
| COMPARATIVE EXAMPLE 7 | JJ | 6.8 | 1.9 | 0.34 | 2.4 | 58 | 284 |
| COMPARATIVE EXAMPLE 8 | KK | 17.5 | 2.0 | 0.19 | 3.4 | 57 | 290 |
| COMPARATIVE EXAMPLE 9 | LL | 12.5 | 1.7 | 0.20 | 8.6 | 56 | 233 |
| COMPARATIVE EXAMPLE 10 | MM | 16.3 | 2.1 | 0.13 | 2.9 | 51 | 302 |
| COMPARATIVE EXAMPLE 11 | NN | 8.1 | 1.6 | 0.15 | 3.4 | 52 | 218 |
| COMPARATIVE EXAMPLE 12 | OO | 11.7 | 3.7 | 0.42 | 3.8 | 50 | 228 |
| COMPARATIVE EXAMPLE 13 | OO | 10.2 | 3.4 | 0.25 | 4.1 | 43 | 238 |
| COMPARATIVE EXAMPLE 14 | OO | 21.6 | 4.3 | 0.38 | 3.7 | 56 | 230 |
| COMPARATIVE EXAMPLE 15 | OO | 12.3 | 3.5 | 0.27 | 4.5 | 48 | 236 |
| COMPARATIVE EXAMPLE 16 | OO | 18.3 | 2.3 | 0.25 | 4.5 | 48 | 228 |
| COMPARATIVE EXAMPLE 17 | OO | SAMPLE COULD NOT BE PRODUCED BECAUSE OF DAMAGE OF DIE DUE TO POOR FORGING WORKABILITY | | | | | |
| COMPARATIVE EXAMPLE 18 | OO | 13.5 | 3.6 | 0.43 | 3.7 | 56 | 235 |
| COMPARATIVE EXAMPLE 19 | OO | 7.3 | 3.3 | 0.31 | 8.3 | 54 | 250 |
| COMPARATIVE EXAMPLE 20 | OO | 9.3 | 2.5 | 0.31 | 4.0 | 57 | 233 |
| COMPARATIVE EXAMPLE 21 | OO | 10.0 | 1.3 | 0.32 | 0 | 48 | 233 |
| COMPARATIVE EXAMPLE 22 | PP | 8.5 | 1.2 | 0.32 | 0 | 56 | 206 |
| COMPARATIVE EXAMPLE 23 | QQ | 7.5 | 1.7 | 0.18 | 2.3 | 95 | 415 |
| COMPARATIVE EXAMPLE 24 | RR | 10.5 | 2.4 | 0.38 | 4.6 | 53 | 209 |
| COMPARATIVE EXAMPLE 25 | SS | 7.8 | 1.8 | 0.23 | 3.4 | 94 | 402 |
| COMPARATIVE EXAMPLE 26 | TT | 8.5 | 2.1 | 0.26 | 3.1 | 55 | 220 |

As shown in Tables 3-1 and 3-2, in examples 1 to 32, since they were within the range of the present invention, it was possible to realize both excellent specularity and workability. Particularly good results were obtained in examples 1 to 26, and 29 to 32 in which the average number of deformation twins per one crystal grain of the α phase was 2.0 to 10.0.

In a comparative example 1, the O content is excessively high, and thus the hardness is excessively high and the workability is low. In a comparative example 2, the Al content is excessively low, and thus the hardness is excessively low and the specularity is low. In comparative examples 3, 4, the Fe content is excessively low, and thus the average grain diameter of the α-phase crystal grains is excessively large, and the specularity is low. In a comparative example 5, the Fe content is excessively high, and thus an acicular microstructure locally exists due to segregation, the coefficient of variation of the number density of the β-phase crystal grains is excessively high, and the specularity is low. In a comparative example 6, the Fe content is excessively low, and thus the average grain diameter of the α-phase crystal grains is excessively large, and the specularity is low. In a comparative example 7, the Fe content is excessively high, and thus the coefficient of variation of the number density of the β-phase crystal grains is excessively high, and the specularity is low. In a comparative example 8, the Fe content is excessively low, and thus the average grain diameter of the α-phase crystal grains is excessively large, and the specularity is low. In a comparative example 9, the Al content is excessively low, and the specularity is low. In a comparative example 10, the Fe content is excessively low, and thus the average grain diameter of the α-phase crystal grains is excessively large, and the specularity is low. In a comparative example 11, the C content is excessively high, and thus TiC is generated, and the specularity is low.

In a comparative example 12, the hot-rolling temperature is excessively high, the average aspect ratio of the α-phase crystal grains is excessively large, and the coefficient of variation of the number density of the β-phase crystal grains is excessively high, and thus the specularity is low. In a comparative example 13, the annealing temperature is excessively low, and the average aspect ratio of the α-phase crystal grains is excessively large, and thus the specularity is low. In a comparative example 14, the annealing temperature is excessively high, the average grain diameter of the α-phase crystal grains is excessively large, the average aspect ratio of the α-phase crystal grains is excessively large, and the coefficient of variation of the number density of the β-phase crystal grains is excessively high, and thus the specularity is low. In a comparative example 15, the annealing time is excessively short, and the average aspect ratio of the α-phase crystal grains is excessively large, and thus the specularity is low. In a comparative example 16, the annealing time is excessively long, and the average grain diameter of the α-phase crystal grains is excessively large, and thus the specularity is low. In a comparative example 17, the forging temperature was excessively low, and thus the metal mold was damaged and it was not possible to produce the sample. In a comparative example 18, the forging temperature is excessively high, the average aspect ratio of the α-phase crystal grains is excessively large, and the coefficient of variation of the number density of the β-phase crystal grains is excessively high, and thus the specularity is low. In a comparative example 19, the number of times of the forging is excessively small, the average aspect ratio of the α-phase crystal grains is excessively large, and the coefficient of variation of the number density of the β-phase crystal grains is excessively high, and thus the specularity is low. In a comparative example 20, the average cooling rate after the forging is excessively low, and the coefficient of variation of the number density of the β-phase crystal grains is excessively high, and thus the specularity is low. In comparative examples 21, 22, the forging is not performed, and the coefficient of variation of the number density of the β-phase crystal grains is excessively high, and thus the specularity is low.

In a comparative example 23, the Al content is excessively high, and thus the hardness is excessively high and the workability is low. In a comparative example 24, the Fe content is excessively high, and thus an acicular microstructure locally exists due to segregation, the coefficient of variation of the number density of the β-phase crystal grains is excessively high, and the specularity is low. In a comparative example 25, the Sn content is excessively high, and thus the hardness is excessively high and the workability is low. In a comparative example 26, the Si content is excessively high, and thus the specularity is low.

EXPLANATION OF CODES

10 . . . β grain having circle-equivalent diameter of less than 0.5 μm

11 . . . β grain having circle-equivalent diameter of 0.5 μm or more and existing across two squares.

What is claimed is:

1. A titanium alloy part, comprising, by mass %:

Al: 1.0 to 8.0%;

Fe: 0.10 to 0.40%;

O: 0.00 to 0.30%;

C: 0.00 to 0.10%;

Sn: 0.00 to 0.20%;

Si: 0.00 to 0.15%; and the balance: Ti and impurities, wherein:

an average grain diameter of α-phase crystal grains is 15.0 μm or less;

an average aspect ratio of the α-phase crystal grains is 1.0 or more and 3.0 or less; and a coefficient of variation of a number density of β-phase crystal grains distributed in the α phase is 0.30 or less.

2. The titanium alloy part according to claim 1, wherein an average number of deformation twins per one α-phase crystal grain is 2.0 to 10.0.

3. The titanium alloy part according to claim 1, wherein the titanium alloy part consists of:

Al: 1.0 to 8.0%;

Fe: 0.10 to 0.40%;

O: 0.0 to 0.30%;

C: 0.00 to 0.10%;

Sn: 0.00 to 0.20%;

Si: 0.00 to 0.15%; and the balance: Ti and impurities.

* * * * *